US005715550A

United States Patent [19]

Griffin

[11] Patent Number: 5,715,550

[45] Date of Patent: Feb. 10, 1998

[54] TRAP DOOR

[76] Inventor: Harry G. Griffin, 2005 Mumphrey Rd., Chalmette, La. 70043

[21] Appl. No.: 689,672

[22] Filed: Aug. 13, 1996

[51] Int. Cl.[6] ..... E03C 1/12

[52] U.S. Cl. ..... 4/679

[58] Field of Search ..... 4/679, 681, DIG. 14; 137/247.41, 247.43, 247.51

[56] References Cited

U.S. PATENT DOCUMENTS

| | | | |
|---|---|---|---|
| 1,198,759 | 9/1916 | Pinder et al. | 137/247.51 |
| 2,593,734 | 4/1952 | Davis | 137/247.51 |
| 4,230,582 | 10/1980 | Taleja | 137/247.51 X |
| 4,700,412 | 10/1987 | Manuel | 4/679 |
| 5,038,816 | 8/1991 | Weltsch | 4/679 |
| 5,058,214 | 10/1991 | Shinn | 4/679 |
| 5,255,402 | 10/1993 | Kashani | 4/679 |

*Primary Examiner*—Charles E. Phillips

*Attorney, Agent, or Firm*—Joseph H. McGlynn, Patent and Trademark Services, Inc.

[57] ABSTRACT

A drain trap which has a removable bottom portion that is attached by means of a hinge element at one end and a catch at an opposite end. Also, the bottom portion of the trap is enlarged to increase water flow and prevent easy clogging of the drain. In addition, a filter element is disposed within the trap and is disposed at an angle, again, to increase water flow and prevent easy clogging of the drain.

6 Claims, 1 Drawing Sheet

TRAP DOOR

BACKGROUND OF THE INVENTION

This invention relates, in general, to a drain trap, and, in particular, to a drain trap that is readily removable for cleaning or retrieving articles that may have accidentally fallen into the drain.

DESCRIPTION OF THE PRIOR ART

In the prior art various types of removable drain traps have been proposed. For example, U.S. Pat. No. 4,700,412 discloses a drain trap having a removable bottom portion which is attached to the top portion by a threaded rod.

U.S. Pat. No. 5,038,816 discloses a removable drain trap which has a bottom portion attached by catches and a filter is supported between the top and bottom portions.

U.S. Pat. No. 5,058,214 discloses a removable drain trap which has a bottom portion which has a hinge at one end and a catch at the opposite end.

U.S. Pat. No. 5,225,402 discloses a removable drain trap which has side catches to secure the removable bottom portion, While drain traps with removable bottom portions have been proposed in the prior art, all of the prior art devices suffer from serious drawbacks. For example U.S. Pat. No. 4,700,412 utilizes a threaded rod which extends through the bottom and top portion and can restrict a portion of the water flow through the drain. The threaded rod also makes it easier for foreign matter to become entangled on the rod which could block the drain.

U.S. Pat. No. 5,038,816 utilizes catches which do not block the water flow, however, this device uses a filter screen which is vertically disposed within the trap which will reduce the water flow through the trap.

U.S. Pat. Nos. 5,058,214 and 5,225,402 utilize non-water blocking snap catches on the outside of the trap, however, they do not provide a filter which will stop the passage of foreign particles which could block the drain or trap valuable articles, such as rings, before they are flushed into the sewer system.

Therefore, there is a need for a drain pipe trap which will catch hair and other foreign objects before they are flushed into the pipe system and collect in an inaccessible spot and thereby block the flow of water. However, the trap must also allow the normal, or near normal flow of water, through the trap. In addition the trap must be easily removed so it can be cleaned or valuable objects such as rings or contact lens can be retrieved from the trap before they are flushed into the pipes and eventually into the sewer system.

SUMMARY OF THE INVENTION

The present invention comprises a drain trap which has a removable bottom portion that is attached by means of a hinge element at one end and a catch at an opposite end. Also, the bottom portion of the trap is enlarged to increase water flow and prevent easy clogging of the drain. In addition, a filter element is disposed within the trap and is disposed at an angle, again, to increase water flow and prevent easy clogging of the drain.

It is an object of the present invention to provide a new and improved drain trap that can be removed for easy cleaning.

It is an object of the present invention to provide a new and improved drain trap that is attached to prevent reduction in the water flow through the drain.

It is an object of the present invention to provide a new and improved drain trap that will not readily clog the drain.

These and other objects and advantages of the present invention will be fully apparent from the following description, when taken in connection with the annexed drawings.

DESCRIPTION OF THE PREFERRED EMBODIMENT

Figure 1:
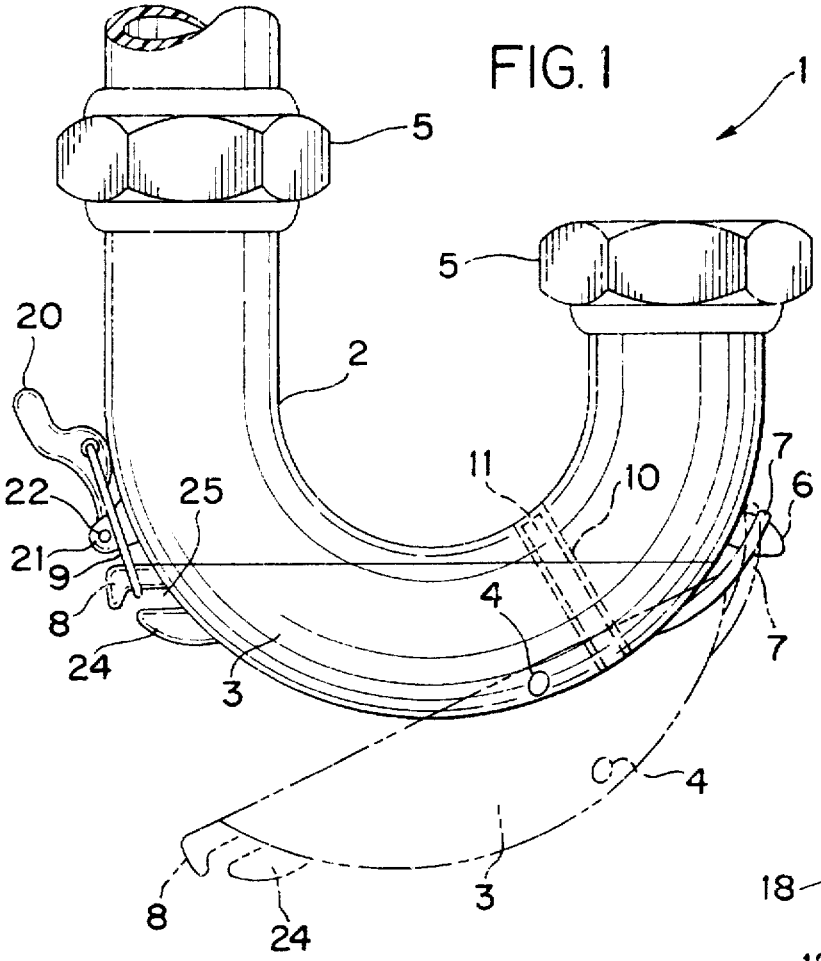
FIG. 1 is a side view of the present invention.

Referring now to the drawings in greater detail, FIG. 1 shows the J-trap or P-trap 1 of the present invention. These traps are commonly used in the drains of sinks in the bathroom or kitchen. The present invention has a pair of nuts 5 to connect the trap 1 to the pipe leading from the sink drain and to the pipe leading to the sewer system (both of which are conventional plumbing fixtures and are, therefore, not shown).

The trap has an upper portion 2 and a lower portion 3 which are connected together to form a water proof connection between the pipe leading from the sink drain and the pipe leading to the sewer system. At one end of the upper portion 2 is a projection 6 around which is looped a circular portion or loop 7 which is attached to the lower portion 3. These two elements form a "hinge" which allows the bottom portion 3 to be pivoted from an open position (shown by the dotted lines in FIG. 1) to a closed position (shown by the solid lines in FIG. 1).

At the opposite end of the trap (the left side as seen in FIG. 1) is a catch to hold the two portions of the trap 2, 3 in engagement. The upper portion 2 has a pivot handle which is pivoted to upper portion 2 by a support 21 and a pivot pin 22. A loop of wire or similar material 9 is pivotally mounted to handle 20 and fits around projection 8, which is secured to lower portion 3 of the drain trap. In order to secure the upper and lower portions of the trap together, handle 20 is pivoted down from the position shown in FIG. 1. This will allow loop 9 to be passed over projection 8 on the lower portion 3. Handle 20 will then be rotated up which will cause the loop 9 to pull projection 8 and lower portion 3 up until the upper and lower portion are engaged.

Figure 2:
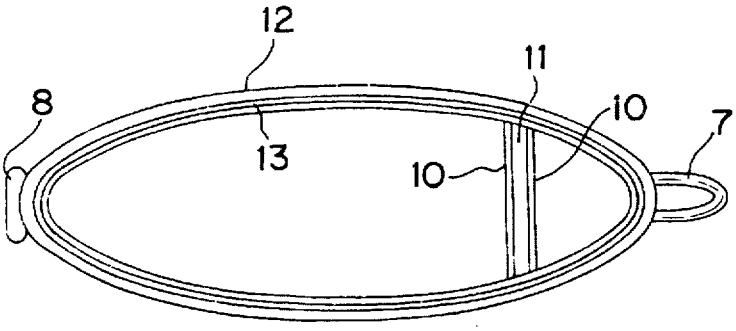
FIG. 2 is a plan view of the O-ring seal of the present invention.

As shown in FIGS. 1 and 2, a filter 11 is mounted within the upper and lower portions to trap foreign objects within the J-trap. Walls 10 are formed integral with the upper and lower portions 2, 3 to form a seat for the filter 11. Part of the walls will be on the upper portion 2 and part of the walls will be on lower portion 3 and, when the portions meet, will form a seat that will securely hold the filter 11 in position. As can be clearly seen in FIG. 1 the filter 1 is mounted on an angle so the face of the filter is not perpendicular to the flow of water through the trap. If the filter were perpendicular to the flow of water in the trap all of the water would hit the filter at the same time, which would impede the flow of water.

This could adversely affect the operation of the trap making it easier for items such as hair to be lodged against the filter which would slow down or even completely stop the flow of water through the trap.

However, with the filter mounted at an angle to the flow of water through the trap, water, as it passes down the drain, will hit one portion of the filter before it hits other portions of the filter. Therefore, the flow of water will not be as impaired by the filter. If the filter has collected foreign objects, such as hair, there will be less likelihood of the filter stopping or seriously impeding the flow of water.

Figure 3:
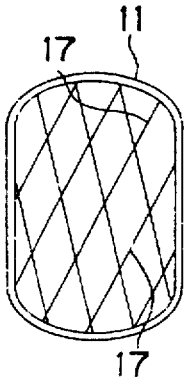
FIG. 3 is a view of the filter of the present invention.

In FIG. 3 a filter 11 used with the present invention is shown. It should be noted that the filter is shown as being oval or elliptical, however, this is merely for illustration purposes and the filter may assume any shape such as, but not limited to, circular or rectangular shapes. The filter has a series of crossing elements 17 which form apertures that should be large enough to pass water freely, but small enough to trap objects such as rings, earrings, and contact lenses. The material of the filter and the crossing elements could be any material that will serve the intended purpose such as, but not limited to, metal or plastic.

Figure 4:
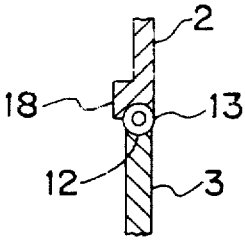
FIG. 4 is a view of the O-ring seal in place.

Positioned around the top of the lower portion 3, as shown in FIG. 2, is a groove 12 which extends around the entire circumference of the lower portion 3. Within this groove is an O-ring seal 13 which can be made from, but not limited to, rubber or plastic. The bottom of the upper portion 2 has a similar groove 18, shown in FIG. 4, and when the two portions 2 and 3 are engaged the O-ring 13 is trapped therebetween in order to seal the joint from water leakage.

Figure 5:
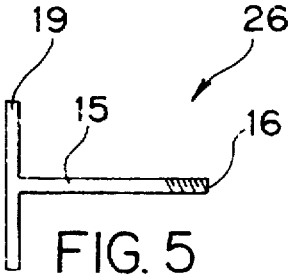
FIG. 5 is a view showing a plug used with the present invention.

As shown in FIG. 1, a threaded aperture 4 is provided in the side of lower portion 3. A plug 26, shown in FIG. 5, is adapted to be threaded into the aperture 4. The plug 26 has a threaded end 16 which will match the threads in the aperture 4. Connected to the threaded end 16 by a shaft 15 is a handle 19 which will allow the user to remove the plug 26 from the aperture 4. In the case where the filter 11 is completely clogged with foreign matter, a vacuum can be created between the upper portion 2 and lower portion 3. In this case it will be very difficult, if not impossible, to separate the upper and lower portions even after the latch 8, 9, 20 is released. By removing the threaded plug 26, the vacuum can be broken and the upper and lower portions can be separated. Since the plug 26 will always be in the aperture 4, and since the plug has a unitary handle 19, which can be used to remove the plug, there will not be a need for the user to find a tool, such as a wrench or screwdriver, in order to remove the plug.

In addition, the present invention provides a second mechanism for separating the upper portion 2 from the lower portion 3 of the drain trap. A second projection 24 is provided on the lower portion 3 of the drain trap just below projection 8, with the two projections separated by a slot 25, as shown in FIG. 1. When the handle 20 is pulled from the closed or latched position (shown in FIG. 1) the loop 9 will move downward toward projection 24 and will engage the upper surface of projection 24 before the handle 20 reaches its fully extended down position. By continuing to pull the handle 20 down, pressure will be applied to the top of projection 24 by loop 9. This will force lower portion 3 away from upper portion 2.

In order to use the present invention, a user, upon encountering a fully blocked or sluggish drain, will first pull down on handle 20 until the loop 9 hits the upper portion of projection 24. If the lower portion 3 moves away from upper portion 2, the user separates the upper and lower portions and cleans out the filter 11 and reassembles the drain. If the upper and lower portions will not separate, the user continues to push down on the handle 20 which forces loop 9 against the top of projection 24 and tends to force lower portion 3 away from upper portion 2. If the upper and lower portions will still not separate, the user turns handle 19 on plug 26 until it is removed from aperture 4, thus breaking the vacuum between the upper and lower portions 2, 3, and then cleans out the filter 11 and reassembles the drain.

Although the Trap Door and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A waste drain pipe trap comprising:

a first member having first and second ends connected by a curved portion, said first and second ends being cylindrical and each having means for connecting said first member to a pair of pipes, said first member being open on a bottom portion, a second member having an open top portion which is shaped complimentary to said open bottom portion on said first member, said second member having a closed bottom portion, whereby when said first and second members are connected a fluid may flow from said first end to said second end, and means for holding said first and second members together, said first and second members having a horizontal axis when connected together, filter means positioned between said first and second members, said filter means having a top portion which forms an angle of less than 90° with said horizontal axis, and a bottom portion which forms an angle of more than 90° with said horizontal axis, wherein said means for holding said first and second members together comprise a hinge means on one end of said first and second members and a catch means on an opposite end of said first and second members, and wherein said catch means comprises a pair of projections on said second member, said projections being spaced apart, a handle means pivotably mounted to said first member for being moved to a first position, which secures said first and second members together, and for being moved to a second position which allows said first and second members to be separated, a loop pivotably mounted to said handle means, said loop adapted to engage one of said projections when said handle means is in said first position, said loop adapted to engage another of said projections when said handle means is in said second position.

2. The waste drain pipe trap as claimed in claim 1, wherein said filter means is comprised of a grid like screen adapted to interrupt foreign matter carried by said fluid.

3. The waste drain pipe trap as claimed in claim 1, wherein said second member has an aperture therein, said aperture having a plug positioned therein to close said aperture.

4. The waste drain pipe trap as claimed in claim 1, wherein said first and second members have complimentary grooves therein, seal means positioned within said grooves for preventing fluid from leaking between said first and second members.

5. The waste drain pipe trap as claimed in claim 1, wherein said handle means is adapted to be moved into a third position, when said handle is moved for said second position to said third position, said loop pushes said another projection in order to forcibly move said second member away from said first member.

6. The waste drain pipe trap as claimed in claim 1, wherein said first and second members have complimentary slot means formed therein for holding said filter means.

* * * * *